US006687480B2

(12) United States Patent
Obrien et al.

(10) Patent No.: US 6,687,480 B2
(45) Date of Patent: Feb. 3, 2004

(54) VARIABLE LENGTH TRANSFER ASSIST BLADE

(75) Inventors: Brendan P. Obrien, Webster, NY (US); Andrew J. Bonacci, Rochester, NY (US); Mark A. Atwood, Rush, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/165,717

(22) Filed: Jun. 7, 2002

(65) Prior Publication Data

US 2003/0039490 A1 Feb. 27, 2003

Related U.S. Application Data

(60) Provisional application No. 60/314,900, filed on Aug. 24, 2001.

(51) Int. Cl.[7] ..... G03G 15/16
(52) U.S. Cl. ..... 399/316
(58) Field of Search ..... 399/311, 312, 399/314, 316, 317, 388

(56) References Cited

U.S. PATENT DOCUMENTS

| | | | | | |
|---|---|---|---|---|---|
| 4,947,214 | A | * | 8/1990 | Baxendell et al. | 399/316 |
| 5,568,238 | A | * | 10/1996 | Osbourne et al. | 399/311 |
| 5,923,921 | A | * | 7/1999 | OuYang et al. | 399/317 X |
| 6,330,418 | B1 | * | 12/2001 | Ahl et al. | 399/311 |
| 6,556,805 | B1 | * | 4/2003 | Kuo et al. | 399/316 |

* cited by examiner

*Primary Examiner*—William J. Royer

(57) ABSTRACT

A contact blade, formed of a plurality of blade segments, is mounted parallel to and spaced from an imaging surface. A plurality of blade lifters, one blade lifter for each of the blade segments, are individually movable from an inoperative position immediately adjacent to the blade segments to an operative position. When in the operative position the engage lifters engage the blade segments and deflect the blade segments. This causes tips of the blade segments to contact a print sheet contacting the imaging surface and press the print sheet against the imaging surface. A lifter activating device moves a current select number of adjacent blade lifters into the operative position.

3 Claims, 11 Drawing Sheets

VARIABLE LENGTH TRANSFER ASSIST BLADE

This application is based on a Provisional Patent Application No. 60/314,900, filed Aug. 24, 2001.

FIELD OF THE INVENTION

The present invention relates generally to a reprographic printing machine. More specifically, the present invention pertains to an apparatus for assisting the transfer of a developed image from an imaging surface, such as a photoconductive surface or intermediate image transfer surface, to a print sheet, such as paper, by optimizing the contact between the print sheet and the imaging surface. The present invention also pertains to such a transfer assist apparatus including a variable length transfer assist blade that may be adjusted for a plurality of different size print sheets.

BACKGROUND OF THE INVENTION

FIG. 1 is a schematic illustration of a typical electrophotographic printing machine 10 that may employ a transfer assist blade according to the present invention (not shown in FIG. 1). The illustrated printing machine 10 includes a conventional photoconductive layer or light sensitive surface 12 on a conductive backing in the form of a photoconductive belt 14. The photoconductive belt 14 is mounted on a plurality of rollers journaled in a machine frame (not shown), in order to rotate the photoconductive belt 14 and cause the photoconductive layer 12 to pass sequentially through a plurality of reprographic process stations A through E.

The several generally conventional processing stations A through E in the path of movement of the photoconductive layer 12 may be as follows. A charging station A, where the photoconductive layer 12 of the photoconductive belt 14 is uniformly charged. An exposure station B, where a light or radiation pattern of a document to be printed is projected onto the photoconductive layer 12 to expose and discharge select areas of the photoconductive layer 12 to form a latent image thereon. A developing station C, where developer material is applied to the photoconductive layer 12 of the photoconductive belt 14 to generate a toner image on the photoconductive layer 12. A transfer station D, where the toner image is electrostatically transferred from the photoconductive surface to a print sheet 30. Finally, a cleaning station E, where the photoconductive surface is brushed or otherwise cleared of residual toner particles remaining thereon after image transfer.

In order to generate multi-color prints, there may be a group of processing stations A through E for each of a plurality of colors. For example, there may be a group of stations A through E for each of yellow, cyan, magenta and black. One method of generating multicolor prints is to arrange all of the color stations around a single photoreceptor and generate a toner image on the photoreceptor for each color, one color at a time. After each individual color toner image is formed on the photoreceptor, it is transferred to an intermediate transfer surface before the next color toner image is generated. This is repeated for each color, thereby building up a full color toner image on the intermediate transfer surface. The full color toner image is then transferred from the intermediate transfer surface to the print sheet. The intermediate transfer surface may be formed on an intermediate transfer belt, roll, drum or other suitable structure. Alternatively, a separate photoreceptor may be provided for each color. In which case, each color toner image is formed on the corresponding photoreceptor and transferred to the intermediate transfer surface, thereby creating a multi-color toner image on the intermediate transfer surface. The multi-color toner image is then transferred from the intermediate transfer surface to the print sheet.

Another method of generating full color prints is to arrange all of the color processing stations around a single photoreceptor and form all of the color toner images, one on top of each other, during a single rotation of the photoreceptor. The full color toner image may then be transferred from the photoreceptor to the print sheet, eliminating the need for an intermediate transfer surface.

Print sheets 30, such as paper or other print substrate, supplied from a sheet feeding tray or sheet feeding module 16, are fed by a series of sheet feeding rollers and guide rails to the transfer station D. At the transfer station D, the developed toner image is transferred from the photoconductive belt 14 (or intermediate transfer surface) to the print sheet 30. The print sheet 30 is then stripped from the photoconductive belt 14 by a sheet stripper and transported to a fusing station F, where a fuser 20 fuses the toner image onto the print sheet 30 in a known manner. The print sheet 30, which now has an image fused to a first face thereof, is then transported by a plurality of rollers to an output tray or stacking module 26 for one-sided or simplex copying. It will be appreciated that the print sheet may pass directly into the stacking module 26. It will also be appreciated that the print sheet may be inverted prior to entering the stacking module 26 or may be inverted and returned to the developing station C for duplex printing.

The various machine operations are regulated by a controller which is preferably a programmable microprocessor capable of managing all of the machine functions and subsystems. Programming conventional or general purpose microprocessors to execute imaging, printing, document, and sheet handling control functions with software instructions and logic is well known and commonplace in the art. Such programming or software will, of course, vary, depending on the particular machine configuration, functions, software type, and microprocessor or other computer system utilized. Those of skill in the software and/or computer arts can readily program the microprocessor and/or otherwise generate the necessary programming from functional descriptions, such as those provided herein, or from general knowledge of conventional functions together with general knowledge in the software and computer arts without undue experimentation. The operation of the exemplary systems described herein may be accomplished by conventional user interface control inputs selected by the operator from the printing machine consoles. Conventional sheet path sensors or switches may be utilized to keep track of the position of documents and print sheets in the machine 10.

The electrophotographic printing process and machine 10 described above, and variations thereof, are well known and are commonly used for light lens copying and digital printing and photocopying. In digital printing and photocopying processes, a latent image is produced by modulating a laser beam or by selectively energizing light emitting diodes in an array of diodes. A digital original may be created digitally in any known manner, or may be a digital image of a hard copy that was previously scanned, digitized and stored in memory. In ionographic printing and reproduction, a charge is selectively deposited on a charge retentive surface in response to an electronically generated or stored image. It should be understood that a drum photoreceptor, or flash exposure may be alternatively employed.

The process of transferring charged toner particles from an image bearing member, such as the photoconductive belt or an intermediate transfer member to a print sheet is accomplished in a reprographic machine by overcoming the adhesive and electrostatic forces holding the toner particles to the image bearing member. This has been accomplished, for example, via electrostatic induction using a corona generating device. The print sheet is placed in direct contact with the developed toner image on the image bearing member, while the reverse side of the print sheet is exposed to a corona discharge. The corona discharge generates ions having a polarity opposite that of the toner particles on the image bearing member. The ions electrostatically attract the toner particles from the image bearing member and into contact with the print sheet, thereby transferring the toner particles from the image bearing member to the print sheet. Other forces, such as mechanical pressure or vibratory energy, have also been used to support and enhance the electrostatic transfer process.

To achieve substantially complete transfer of the developed image to the print sheet, it is necessary for the print sheet to be in intimate uniform contact with the image bearing member. However, the interface between the image bearing member and the print sheet is rarely uniform. Print sheets that have been mishandled, left exposed to the environment, or previously passed through a fixing operation (e.g., heat and/or pressure fusing) tend to be non-flat or uneven. An uneven print sheet makes uneven contact with the image bearing member. In the event that the print sheet is wrinkled, the print sheet will not be in continuous intimate contact with the image bearing member. Wrinkles in the print sheet cause spaces or air gaps to materialize between the developed toner particle image on the image bearing member and the print sheet. When spaces or gaps exist between the developed image and the print sheet, various problems may result. For example, there is a tendency for toner particle not to transfer across the gaps, causing variable transfer efficiency and creating areas of low toner particle transfer or even no transfer. A phenomenon known as image transfer deletion. Clearly, image transfer deletion is undesirable in that portions of the desired image may not be appropriately reproduced on the print sheet.

One known approach for curing the transfer deletion problem is illustrated in U.S. Pat. No. 5,247,335 to Smith et al., which discloses a flexible blade member, or so-called transfer assist blade. A solenoid-activated lever arm moves the transfer assist blade from a non-operative position spaced from the print sheet, to an operative position in contact with the print sheet. When in the operative position, the transfer assist blade presses the print sheet into contact with a developed image on a photoconductive surface, thereby substantially eliminating wrinkles in the print sheet and gaps between the print sheet and the photoconductive surface.

U.S. Pat. No. 4,947,214 to Baxendell et al. and U.S. Pat. No. 5,227,852 to Smith et al. each disclose a transfer assist blade formed of two separately actuated segments, thereby providing a variable length transfer assist blade. A first of the segments is actuated when an 11 inch sheet is passing through a developing station. Both segments are actuated when a 14 inch sheet is passing through the developing station. A separate blade actuating motor and linkage arrangement is provided for each blade segment.

U.S. Pat. No. 5,300,993 to Vetromile and U.S. Pat. No. 5,300,944 to Gross et al. each disclose a variable length transfer assist blade apparatus formed of a plurality of blade segments. In order to accommodate print sheets of a plurality of cross-process dimensions, varying numbers of the blade segments are selectively actuated into and out of their operative position in contact with the print sheet by a cam shaft. The cam shaft has a plurality of lobes or cam segments of varying length. The cam shaft is rotated so that the lobe having a length that corresponds to the desired actuated or unactuated length of the transfer assist blade presses against the blade segments. Thus, the cam shaft deflects the desired number of blade segments into (see Gross et al.) or out of (see Vetromile et al.) contact with the photoconductive surface. The cam shaft disclosed by Vetromile et al. and Gross et al. enables the selective deflection of varying numbers of blade segments with a single drive motor that rotates the cam shaft.

For obvious reasons, it is desirable that the size or footprint of modern reprographic printing machines be as small as possible. As the size of the reprographic machines is reduced, the space available in the printing machine for the transfer assist blade and associated mechanisms is similarly reduced. Furthermore, the space between the corona generating device and the photoconductive surface is extremely limited. The space limitations are multiplied in full color xerographic machines. A color xerographic printing machine typically has a plurality of sets of charging, developing and transfer stations, for example, one set for each of yellow, cyan, magenta and black, packed into the available interior space. Due to the limited space available in reprographic printing machines, the prior art variable length transfer assist blade systems are limited to providing segmented transfer assist blades having lengths corresponding to a relatively limited number of discrete sheet dimensions.

Many of the existing variable length transfer assist blade devices require a separate actuation motor and linkage for each blade segment. As the number of blade segments is increased, the number of motors and links is also increased. As a result, the cost and complexity of the system increases dramatically as the number of blade segments is increased. Furthermore, only a limited number of motors and associated linkage mechanisms will fit within the available space. On the other hand, existing devices that employ a single cam shaft to actuate all of the transfer assist blade segments eliminate the need for a separate drive motor and linkage for each blade segment. As the number of blade segments is increased, however, the number of cam lobes spaced around the periphery of the cam shaft must also increase. As the number of cam lobes spaced around the periphery of the cam shaft increases, the diameter of the cam shaft must be increased. The diameter of the cam shaft is limited by the available space within the reprographic printing machine. As a result, the number of cam lobes and the number of separately actuatable transfer assist blade segments are likewise limited.

The few discrete transfer assist blade dimensions available in the prior art devices may not always correspond to the dimension of the print sheets being processed for imaging in a reprographic printing machine. For example, a reprographic printing machine may be provided with a transfer assist blade having variable segmented lengths corresponding to print sheets having cross-process dimensions or width of 11", 11.7", 13", and 14". In the case where a 10" paper width is to be processed through the transfer station, the 11" blade segment is actuated. As a result, an inch of the transfer assist blade contacts the surface of the photoreceptor. The area of the blade that contacts the photoreceptor will, in most instances, pick up residual dirt and toner from the photoconductive surface. The next job run which processes print sheets having a dimension greater than 10" will have the residual dirt on the transfer assist blade transferred to the back side of the print sheet, resulting in an unacceptable print quality defect. More importantly, continuous frictional contact between the blade and the photoreceptor may cause permanent damage to the photoreceptor.

In the case of a print sheet having a dimension of, for example, 12.5", the transfer assist blade segments corresponding to a print sheet dimension of 11.7" may be actuated. In this case, the widthwise marginal regions of the print sheet extending beyond the 11.7 inches will not be pressed against the photoconductive surface by the transfer assist blade. As a result, the risk of transfer deletions intended to be eliminated by the transfer assist blade will not be prevented in those portions of the print sheet extending beyond the marginal regions of the transfer assist blade.

There is a need in the prior art for a variable length transfer assist blade having a large number of available lengths, in order to accommodate print sheets having a large number of different cross-process dimensions or widths. Such a transfer assist blade must fit within the limited space available in modern electrostatographic printing and copying machines. It is also may be desirable for such a transfer assist blade to be capable of switching from one width to another quickly enough to do so between pitches (i.e. in between immediately consecutive print sheets), and thereby avoid the need to skip a pitch.

SUMMARY OF THE INVENTION

An apparatus according to one form of the present invention includes a resilient contact blade having a blade root and a blade tip. The blade is movable from an inoperative position in which the blade root is spaced from a print sheet contacting an imaging member by a first distance and the blade tip is spaced from the print sheet to an operative position in which the blade root is spaced from the print sheet by a second distance that is greater than the first distance. A blade deflector located in the path of travel of the blade from the inoperative position to the operative position, wherein, while the blade is moving from the inoperative position to the operative position the blade engages the deflector. When the blade is in the operative position the blade is deflected by the deflector causing the blade tip to contact the print sheet and press the print sheet against the imaging member.

An apparatus according to another form of the present invention includes a contact blade, formed of a plurality of blade segments, mounted parallel to and spaced from an imaging surface. A plurality of blade lifters, one blade lifter for each of the blade segments, are individually movable from an inoperative position immediately adjacent to the blade segments to an operative position. When in the operative position the lifters engage the blade segments and deflect the blade segments causing tips of the blade segments to contact a print sheet contacting the imaging surface and press the print sheet against the imaging surface. A lifter activating device for moving a current select number of adjacent blade lifters into the operative position. The current select number being selected such that a current number of adjacent blade segments having a cumulative length that is equal to a width of a current print sheet contacting the imaging surface are deflected and contact with the current print sheet. A lifter locking member for engaging the current select blade lifters in the operative position and current non-selected blade lifters in the inoperative position while the current print sheet is in contact with the imaging surface.

Another form of the present invention includes a contact blade mounted parallel to and spaced from an imaging surface, the contact blade being formed of a plurality of blade segments. A plurality of blade lifters, one blade lifter for each of the blade segments, are individually movable from an inoperative position immediately adjacent to the blade segments to an operative position in which the lifters engage the blade segments. In the operative position the lifters deflect the blade segments causing tips of the blade segments to contact a print sheet contacting the imaging surface and press the print sheet against the imaging surface. A guideway extending along ends of the blade lifters remote from the contact blade. An elongate cam slidably mounted in the guideway, the cam having gear teeth formed along one side thereof. A pinion gear mounted adjacent to the guideway in engagement with the gear teeth on the cam. A motor operatively connected to the pinion gear for rotating the pinion gear, moving the cam in the guideway, and thereby moving a select number of the blade lifters into the operative position. The select number being selected such that a select number of adjacent blade segments having a cumulative length that is equal to a width of the print sheet contacting the imaging surface are deflected and contact the print sheet.

BRIEF DESCRIPTION OF THE DRAWINGS

The invention will now be described, by way of example, with reference top the following drawings, of which.

For a general understanding of the features of the present invention, reference is made to the drawings, wherein like reference numerals have been used throughout to identify identical or similar elements.

DESCRIPTION OF THE INVENTION

Figure 2:
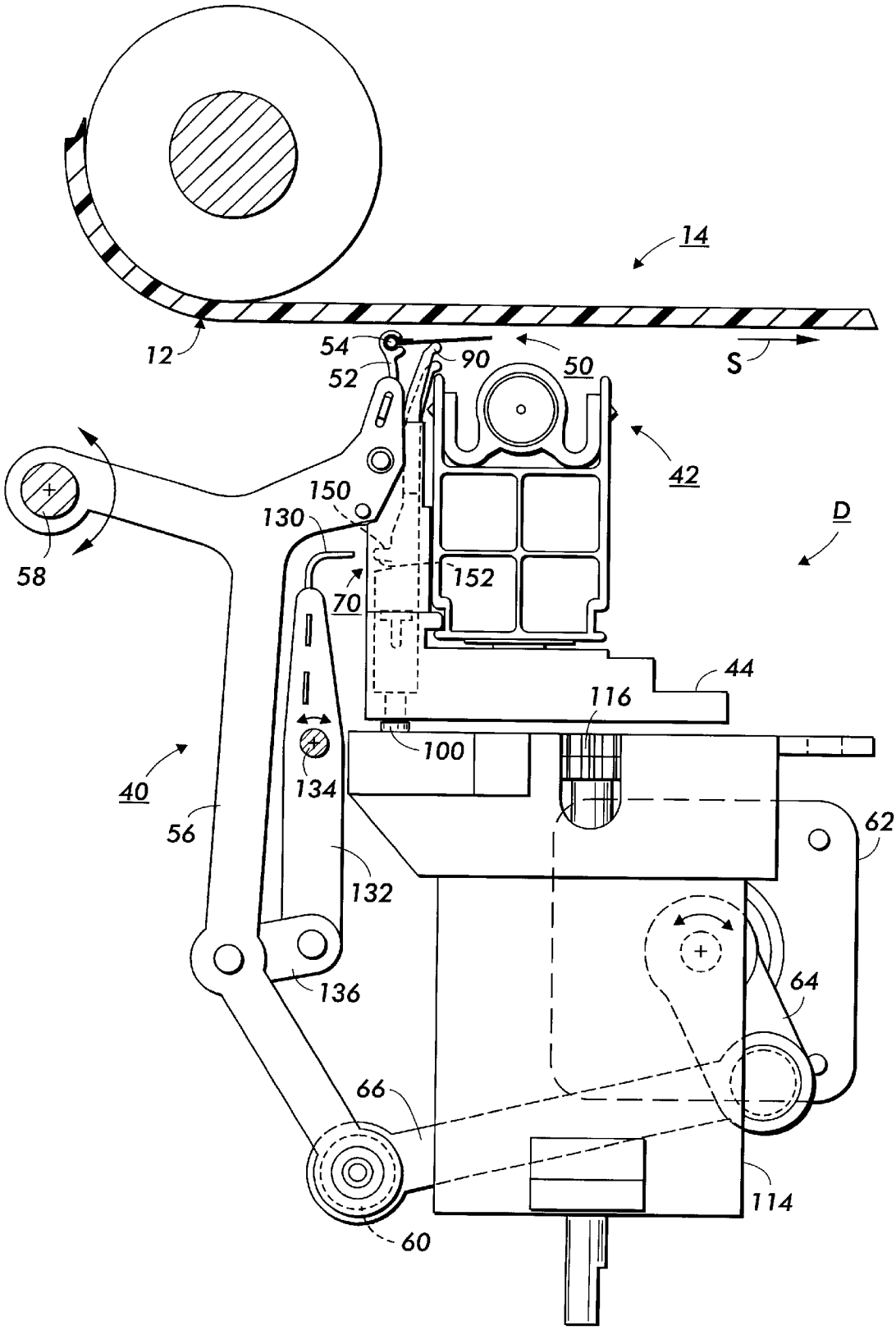
FIG. 2 is side plan view of a transfer assist blade and associated actuating mechanism according to an embodiment of the present invention, showing the transfer assist blade in the unengaged position.
Figure 3:
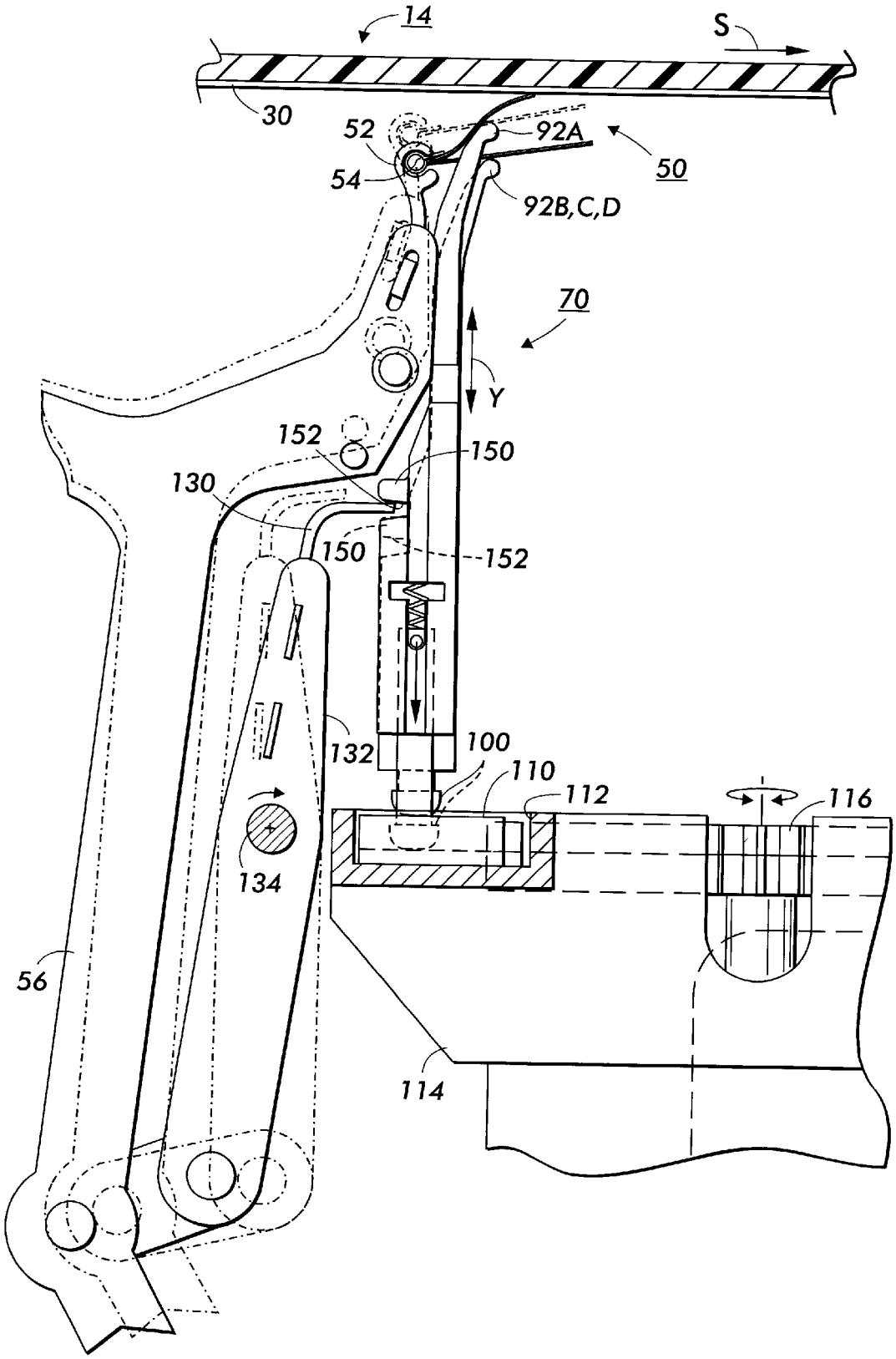
FIG. 3 is an enlarged front plan showing the transfer assist blade and associated actuating mechanism of FIG. 2 in the engaged position.
Figure 4:
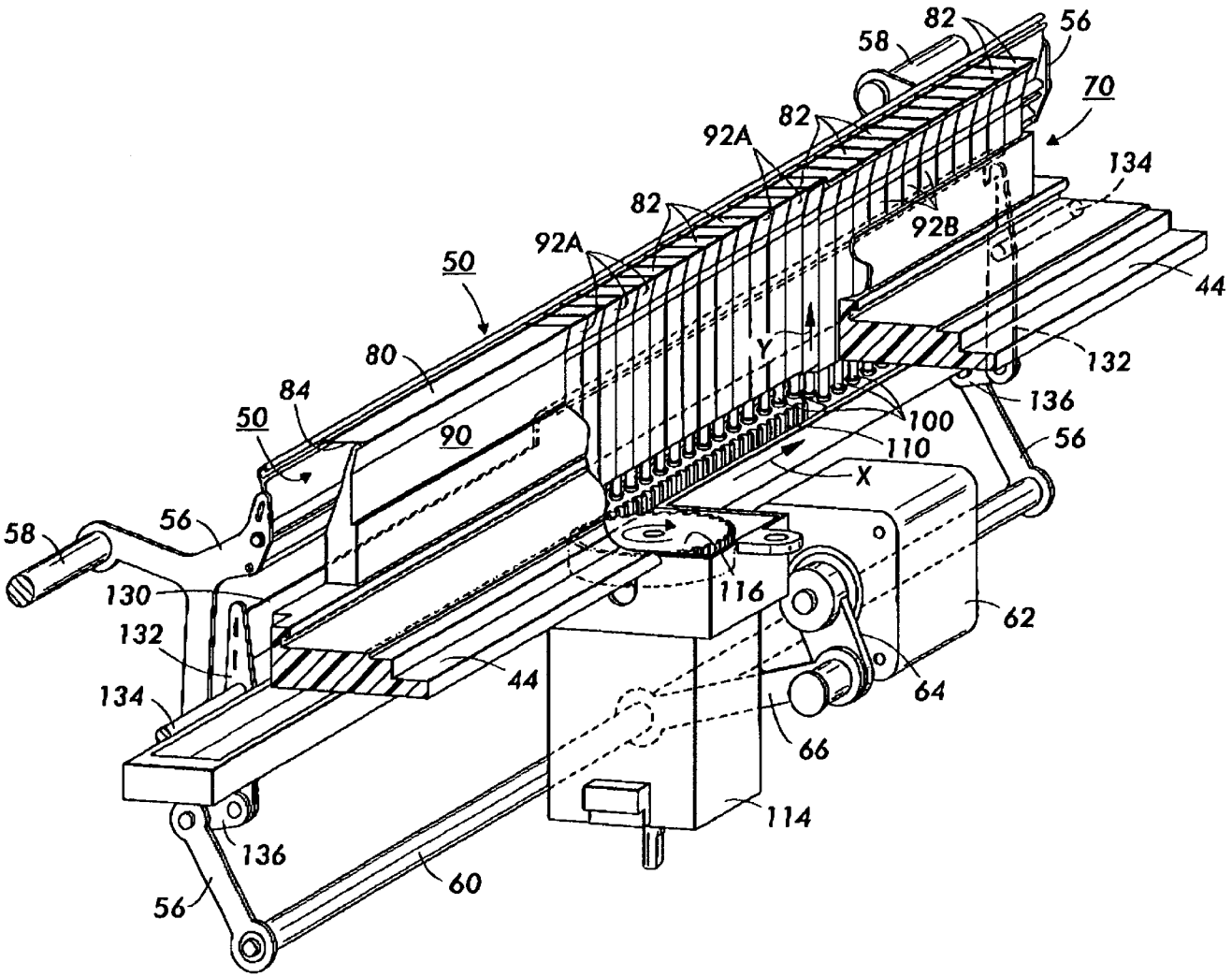
FIG. 4 is a partially broken away perspective view of the transfer assist blade and associated actuating mechanism of FIG. 2.

A transfer station D incorporating a transfer assist blade mechanism 40 according to one form of the present invention is illustrated in FIGS. 2 through 4. The illustrated transfer station D includes a corona generating device 42 attached to base plate 44 that is mounted to the machine frame (not shown). The corona generating device 42 (only shown in FIG. 2) charges a print sheet 30 (shown in FIG. 3) to the proper magnitude and polarity, so that the print sheet 30 is tacked to photoconductive belt 14 and moves in unison with photoconductive belt 14 in the direction of arrow S. As the print sheet 30 moves in unison with the photoconductive belt 14, a toner image is electrostatically attracted from the photoconductive belt 14 to the print sheet 30.

The transfer assist blade mechanism 40 also includes a transfer assist blade 50. As the print sheet 30 moves into a transfer zone between the corona generating device 42 and the photoconductive belt 14, the transfer assist blade 50 is pressed against the print sheet 30 (As shown in FIG. 3). Thus, the transfer assist blade 50 applies a uniform contact pressure to the print sheet 30 as it passes through the transfer station D, for pressing the print sheet 30 into uniform contact with the photoconductive surface 12 of the photoconductive belt 14.

Figure 6:
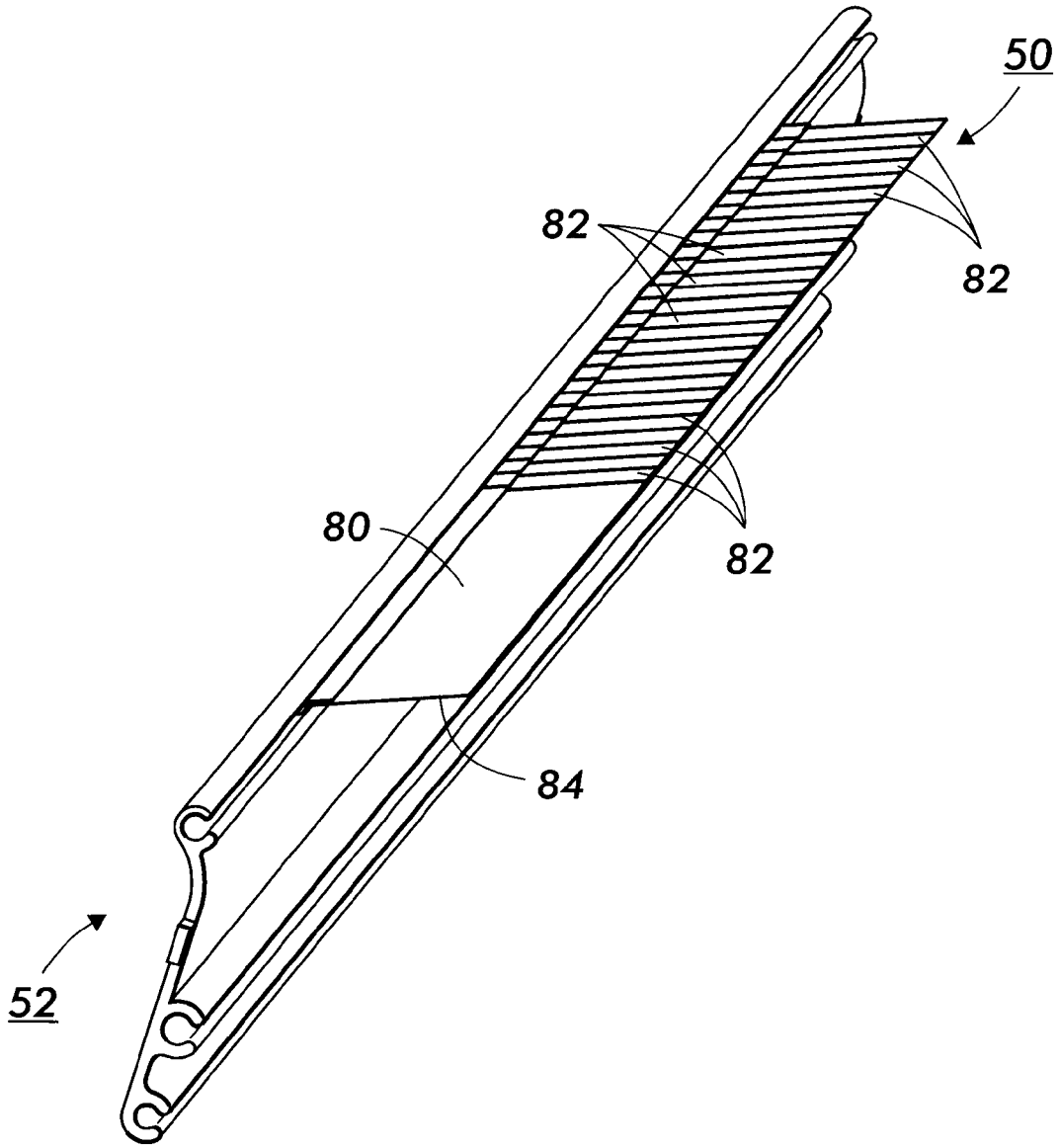
FIG. 6 is a perspective view of the transfer assist blade and a blade holder of FIG. 2.

The transfer assist blade 50 is secured in a blade holder 52 (also see FIG. 6) by wrapping one elongate edge of the transfer assist blade 50 around a retaining rod 54, and securely snapping or sliding the retaining rod 54 into a C-shaped retaining head formed on the blade holder 52 (best seen in FIG. 3). The blade holder 52 is secured between a pair of pivot arms or blade brackets 56, only one of which is visible in FIGS. 2 and 3. The pivot arms 56 are pivotally journaled on a pair of blade axles 58 that are affixed to a portion of the machine frame (not shown). Lower ends of the pivot arms 56 are interconnected by a bar 60 that extends therebetween. A first stepper motor 62 is secured to the base plate 44 or is otherwise secured to the machine frame. A crank arm 64 is secured to the output shaft of the first stepper motor 62. The crank arm 64 is connected to the bar 60 by a link 66. The blade axles 58 are offset to one side of the pivot arms 56 by legs that extend from the pivot arms 56.

With this construction, pivotal motion of the pivot arms 56 in a clockwise direction about the axles, causes the transfer assist blade 50 to move generally down, away from the photoconductive belt 14, from an inoperative position shown in FIG. 2 (and in ghost in FIG. 3) to an operative position shown in FIG. 3. A blade deflector or lifter 70 is secured to the base plate 44, such that the blade lifter 70 is located to engage a central portion of the transfer assist blade 50 when the transfer assist blade 50 is moved into the operative position. In order to move the transfer assist blade 50 from the inoperative to the operative position, the pivot arms 56 only need to be pivoted about the blade axles 58 a small amount, for example 4 degrees. The force applied by the transfer assist blade 50 to the print sheet 30 may be controlled by adjusting the degree of rotation of the pivot arms 56 under the control of the first stepper motor 62.

All terms of orientation, such as up, down, lower, upper, left, right, front and back are relative to the orientation of the apparatus as shown in the appended Figures. It will be appreciated that the apparatus may be employed in different orientations, such that upper and lower may, for example, be reversed or become left and right. Use of such terms of orientation in the description of the illustrated embodiment of the invention and in the appended claims is for the purpose of facilitating the description of the arrangement and interaction of the components of the invention relative to each other. As such, the use of such terms of orientation in the present description and in the appended claims is not intended to limit the invention to any particular orientation. The use of such terms is only intended to set forth the arrangement and interaction of the components relative to each other, whatever the orientation of the overall arrangement may be.

Figure 1:
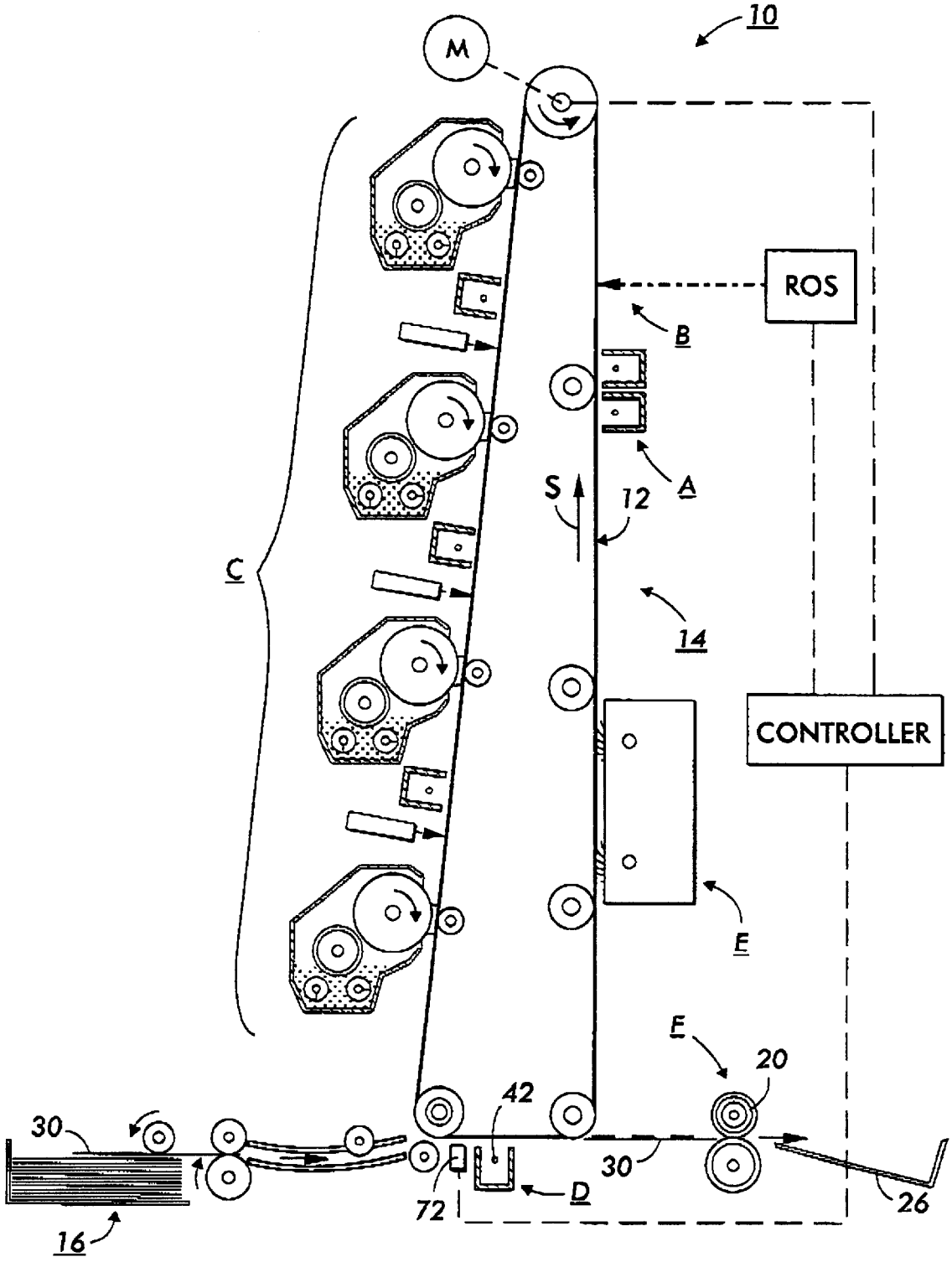
FIG. 1 PRIOR ART
FIG. 1 is a diagrammatic illustration of an exemplary reprographic printing machine.

An optical sheet sensor 72 (in FIG. 1) may be provided for detecting the leading edge of a print sheet 30 as it enters the transfer station D, or as the print sheet 30 travels through an area of the machine 10 prior to delivery to the transfer station D. The signal from the optical sheet sensor 72 is processed by the controller for controlling the actuation of the transfer assist blade mechanism 40. When a signal indicating an incoming print sheet 30 is received by the controller from the optical sheet sensor 72, the controller activates the first stepper motor 62 to rotate in a clockwise direction as viewed in FIGS. 2 through 4.

Rotation of the first stepper motor 62 in the clockwise direction causes the pivot arms 56 to pivot clockwise about the blade axles 58. This causes the blade holder 52 to move the root of the transfer assist blade 50 generally down, away from the photoconductive belt 14, from the inoperative position (shown in FIG. 2 and in ghost in FIG. 3) to the operative position (shown in solid lines in FIG. 3). When the root of the transfer assist blade 50 moves down toward the operative position, the blade lifter 70 engages the central portion of the transfer assist blade 50. As the transfer assist blade 50 continues to move into the operative position, the blade lifter 70 causes the transfer assist blade 50 to deflect upwardly, such that the tip of the transfer assist blade contacts the underside of the print sheet 30 passing through the transfer station D.

As the trailing edge of the print sheet 30 passes the optical sheet sensor 72, the optical sheet sensor 72 again transmits a signal to the controller. Upon receiving this signal, the controller rotates the first stepper motor 62 in the counter-clockwise direction, thereby shifting the transfer assist blade 50 into its inoperative position as illustrated in FIG. 2, immediately before the trailing edge of the print sheet 30 arrives at the transfer assist blade 50. In the inoperative position, the transfer assist blade 50 is spaced from the print sheet 30 and the photoconductive belt 14, ensuring that the transfer assist blade 50 does not scratch the photoconductive belt 14 or accumulate toner particles therefrom which might otherwise be deposited on the backside of the next successive print sheet 30.

Also, when in the inoperative position the transfer assist blade 50 is disengaged from and is not deflected by the blade lifter 70, and is therefore advantageously in a relaxed, un-flexed condition. Since the transfer assist blade 50 spends more time in the inoperative position than in the operative position, the transfer assist blade 50 will therefore be less likely to take a set and will have a longer life span than a transfer assist blade 50 in an arrangement that flexes transfer assist the blade 50 in the inoperative position.

The embodiment described herein and shown in the amended Figures is intended to disclose one form of the present invention by way of example only. It will be understood that the first stepper motor 62 and crank arm 64 arrangement shown in FIG. 2 represents one of various means for selectively pivoting the pivot arms 56 for positioning the transfer assist blade 50. Numerous other apparatus or systems, such as a solenoid device, a cam assisted assembly, or other suitable mechanism, may alternatively be incorporated into the present invention in place of the illustrated first stepper motor 62 and crank arm 64 for facilitating the same or a similar function. Similarly, the optical sheet sensor 72 may be any type of sensor or switch that is suitable for detecting the presence of a print sheet 30.

Figure 5:
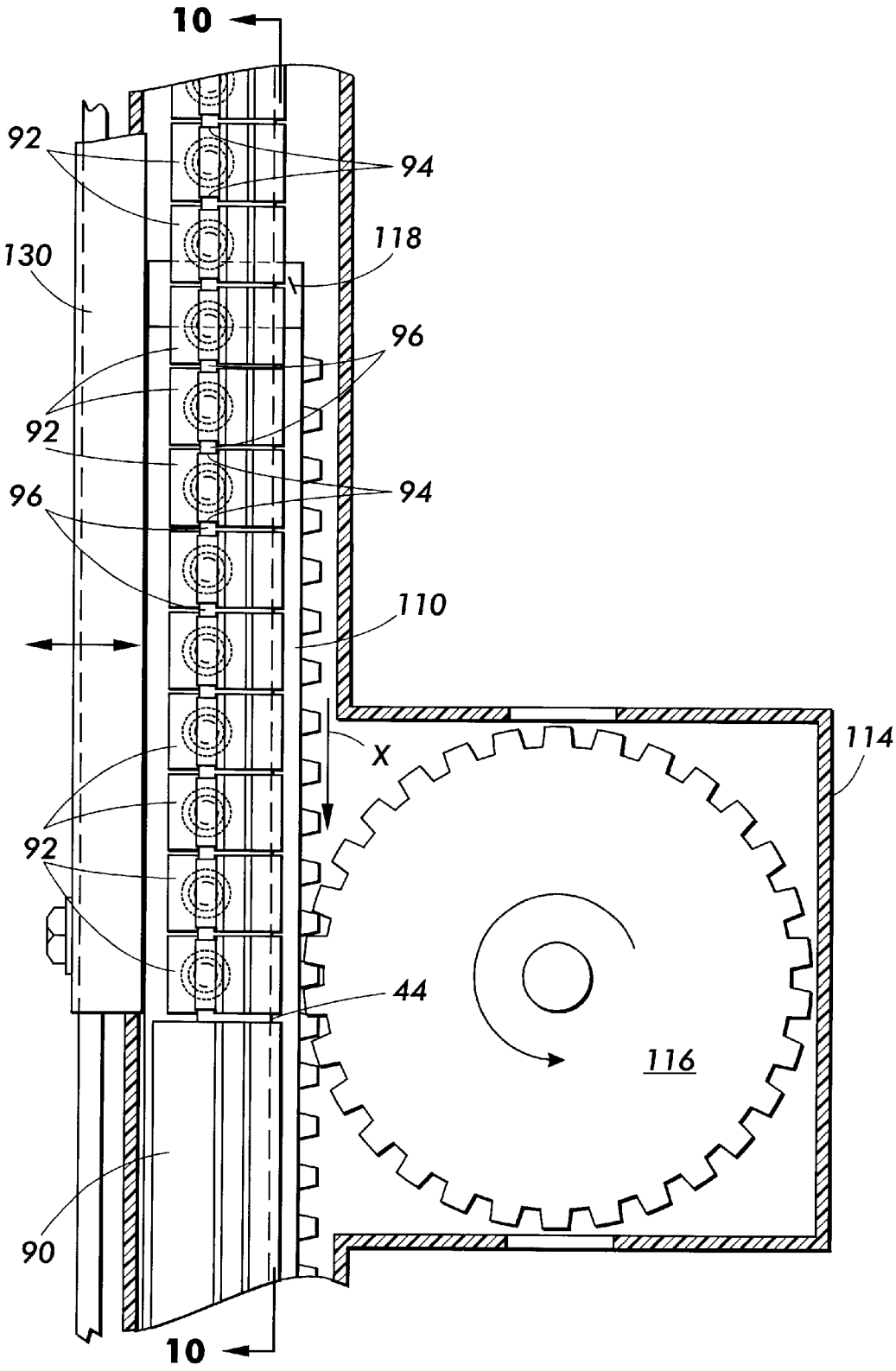
FIG. 5 is a partial cross-sectional top view of the associated actuating mechanism of FIG. 2.

The transfer assist blade mechanism 40 according to one form of the present invention includes a variable length transfer assist blade 50. With particular reference now to FIGS. 4 and 5, the transfer assist blade 50 has a plurality of slits formed therein that separate the transfer assist blade into a plurality of blade segments. A first or primary blade segment 80 and a plurality of smaller secondary or auxiliary blade segments 82 extending along a substantially common longitudinal axis substantially parallel to the photoconductive surface 12 of photoconductive belt 14. Each blade segment may be fabricated from a resilient, flexible material, as for example, Mylar, manufactured by E. I. DuPont de Nemours, Co. of Wilmington, Del. The plurality of blade segments cooperate, as discussed in further detail below, for providing a variable length transfer assist blade 50.

The primary blade segment 80 has a length corresponding to the smallest process width dimension of a print sheet 30 contemplated for use in the machine 10, for example, 5.5 inches. The transfer assist blade 50 is mounted in the blade holder 52 such that its outboard end 84 is in alignment with the outboard edge of the photoconductive belt 14. The auxiliary blade segments 82 can be of any length, but in most instances will be shorter than the primary blade segment 80 and may be, for example, 8.5 millimeters in length each. The cumulative length of the primary blade segment 80 and the auxiliary blade segments 82 matches the greatest process width dimension of a print sheet 30 contemplated for use in the machine 10, typically the width of the photoconductive belt 14, which may be, for example, 14.33 inches. The number of available discrete variable transfer assist blade lengths corresponds with the overall number of blade segments 80 and 82. Thus, the greater the number of auxiliary blade segments 82, the greater the number of available blade lengths. The auxiliary blade segments 82 are illustrated as all being of a common length. It will be appreciated, however, that the auxiliary blade segments 82 may be of varying lengths that are selected to provide the desired discrete blade widths.

As best seen in FIGS. 4 and 5, the blade lifter 70 is formed of a plurality of individual blade lifters or deflectors 70. A primary blade lifter 90 is immovably affixed to the base plate 44 in a blade deflecting or operative position. The primary blade lifter 90 may alternatively be formed as an integral unitary part of the base plate 44. A plurality of smaller auxiliary blade lifters 92 are mounted for reciprocal vertical movement relative to the base plate 44. Referring now to the partial cross-sectional top view of FIG. 5, vertical guide channels 94 are formed in the base plate 44 for each of the auxiliary blade lifters 92. Vertical guide ribs 96 extend from the sides of the vertical guide channels 94. The vertical guide ribs 96 are slidably received within vertical grooves 98 (see FIGS. 7 and 8) formed in the sides of each auxiliary blade lifters 92. Thus, the auxiliary blade lifters 92 are guided in the vertical direction by the vertical guide ribs 96, which act as guide rails for the auxiliary blade lifters 92. Cam followers 100 extend from the lower ends of the auxiliary blade lifters 92. A cam 110 is slidably mounted in a channel 112 formed, for example, in an extension of a second stepper motor's housing.

In order to selectively move the cam 110, a second stepper motor 114 is mounted to the base plate 44 or otherwise mounted to the machine frame. A pinion gear 116 is affixed to the output shaft of the second stepper motor 114. Gear teeth formed in the edge of the cam 110 mesh with the gear teeth on the pinion gear 116. The right end of the cam 110 (as viewed in FIG. 4) tapers downward defining an upwardly facing inclined cam surface 118 (see FIG. 5). When the second stepper motor 114 is rotated clockwise, the pinion gear 16 moves the cam 110 to the right in FIG. 4, as indicated by arrow X in FIG. 4. As the cam moves to the right, the cam 110 surface 118 engages the cam followers 100 and pushes the auxiliary blade lifters 92 up, one by one, from the lower inoperative position to the upper operative position as indicated by arrow Y in FIG. 4. The auxiliary blade lifters 92 only need to move up far enough to engage and deflect the auxiliary blade segments 82. For example, a distance of approximately 3 millimeters may suffice, depending on the overall configuration of the system. Positive stops may be provided in the vertical guide channels 94 to stop the auxiliary blade lifters 92 upward movement and accurately locate the auxiliary blade lifters 92 in the operative position relative the photoconductive belt 14.

When the second stepper motor 114 is rotated counterclockwise, the cam 110 moves to the left, out from under the auxiliary blade lifters 92, one by one, such that the auxiliary blade lifters 92 move back down to the inoperative position. In this manner, the pinion gear 116 moves the cam 110 into a position that lifts a selective number of auxiliary blade lifters 92, which correspond to the desired auxiliary blade segments 82, into the operative position. When the transfer assist blade 50 is subsequently moved by the first stepper motor 62 into the operative position, the raised auxiliary blade lifters 92 deflect the corresponding auxiliary blade segments 82 against the print sheet 30. In this manner, the desired effective blade length is deflected into contact with the print sheet 30.

By way of example, when processing a print sheet 30 having a 10" process width in a machine 10 having a 10" long primary blade lifter 90 and primary blade segment 80, all of the auxiliary blade lifters 92 are positioned in the lower inoperative position. Thus, only the primary blade segment 80 is deflected into contact with the print sheet 30. However, when the process width of the print sheet 30 is greater than the length of the primary blade segment 80, then select auxiliary blade lifters 92 adjacent to the primary blade lifter 90 are activated to deflect auxiliary blade segments 82 in to contact with the print sheet 30. The number of deflected auxiliary blade segments 82 is selected such that the inboard edge of the activated auxiliary blade segments 82 precisely corresponds to, or is just shy of the inboard edge of the print sheet 30. The print sheet 30 is pressed against the surface of the photoconductive belt 14 by both the primary blade segment 80 and the deflected auxiliary blade segments 82.

Operation of the above-described variable length transfer assist blade mechanism 40 is as follows. The transfer assist blade 50 is first placed into the inoperative position by the first stepper motor 62. While the transfer assist blade 50 is in the inoperative position, the number of auxiliary blade lifters 92 that correspond to the width of an incoming print sheet 30 are placed in the operative position by appropriately locating the cam 110 with the second stepper motor 114. When the incoming sheet 30 enters the transfer station D, the first stepper motor 62 is activated to move the transfer assist blade 50 into the operative position. As the transfer assist blade 50 moves into the operative position, the primary blade segment 80 and the auxiliary blade segments 82 that correspond to the auxiliary blade lifters 92 in the upper operative position are deflected such that the tips of these auxiliary blade segments 82 contact the print sheet 30. The auxiliary blade segments 82 that correspond to the inactivated auxiliary blade lifters 92 in the lower inoperative position remain undeflected and therefore remain in the inoperative position and do not contact the print sheet 30. Thus, only the blade segments 80 and 82 whose total combined width is equal to or somewhat less than the cross-process width dimension of the print sheet 30 traveling through the transfer station D are activated. Just prior to the print sheet exiting from the transfer station D, the first stepper motor 62 is activated to move the blade holder 52 to the inoperative position. Thus, all of the blade segments 80, 82 are disengaged from the blade lifters 90, 92 and move into the undeflected inoperative position spaced from the photoconductive belt 14 as show in FIG. 2. This process is repeated for each consecutive print sheet 30 entering and exiting the transfer station D.

The second stepper motor 114 retains the cam 110 in a fixed position as long as print sheets 30 of the same cross-process dimension, or width, are entering the transfer station D. When a next print sheet 30 entering the transfer station D has a different width than the preceding print sheet 30 just exiting the transfer station D, then the second stepper motor 114 must reposition the cam 110 to raise the correct number of auxiliary blade lifters 92 into the operative position. The second stepper motor 114 must make the transfer assist blade width adjustment in the inter-document zone, i.e. between consecutive print sheets 30, while the blade holder 52 is in the inoperative position. In high speed printing machines, it may be necessary to skip a pitch (a section of the photoconductive belt 14 equal to one sheet), in order to provide enough time for the second stepper motor 114 to move the cam 110 into the desired position before the next print sheet 30 to be printed on enters the transfer station D. Since this adjustment is only made when there is a change in print sheet width, skipping a pitch when making the transfer assist blade width adjustment is acceptable in most circumstances.

In some instances, skipping a pitch every time a transfer assist blade width adjustment must be made may be undesirable. This may be true for high-speed printers and copiers, particularly when printing on small print sheets 30. Skipping pitches decreases the overall output speed of the machine. Skipping pitches also requires additional programming to maintain synchronization of the toner images on the photoconductive belt 14 with the incoming print sheets 30 and maintain proper registration of the image with the print sheets 30.

Referring once again to FIGS. 2 through 4, an optional embodiment of the present invention includes a parking brake feature. The parking brake feature allows the second stepper motor 114 to adjust the position of the cam 110 in the middle of a pitch, i.e. while a print sheet 30 is currently passing through the transfer station D, rather than only in the inter-document zone.

One possible form of a parking brake includes a blade lifter locking member or parking brake 130 mounted between a pair of end flanges 132 (only one of which is visible in FIGS. 2 and 3). The end flanges 132 are mounted for rotation about a pair of pins 134 secured to the machine frame (not shown) and journaled through a central portion of the end flanges 132. The parking brake 130 extends from one end of the end flanges for pivotal motion therewith into and out of engagement with the auxiliary blade lifters 92. A pair of links 136 connect the ends of the end flanges 132 remote from the parking brake 130 to the pivot arms 56. The links 136 are connected to the pivot arms 56 at a location spaced from the blade axles 58 of the pivot arms 56. With this construction, when the pivot arms 56 are pivoted by the first stepper motor 62 into the operative position, the links 136 cause the end flanges 132 to rotate about the pins 134. Rotation of the end flanges 132 causes the parking brake 130 to pivot from an unparked or disengaged position clear of the auxiliary blade lifters 92 (shown in FIG. 2 and in ghost in FIG. 3), to a parked or locked position engaging the auxiliary blade lifters 92 (shown in solid lines in FIG. 3).

The parking brake 130 has been described above as pivoting about pins 134 along with motion of the pivot arms 56, due to the links 136. It will be appreciated that other arrangements may be provided for selectively moving the parking brake 130. For example, the parking brake may translate, rather than pivot, and may be actuated by a separate stepper motor or solenoid. One of skill in the art will envision various arrangements for actuating the parking brake 130 upon reviewing the present description and appended drawings, all of which are intended to be within the scope of the present invention and the appended claims.

Figure 7:
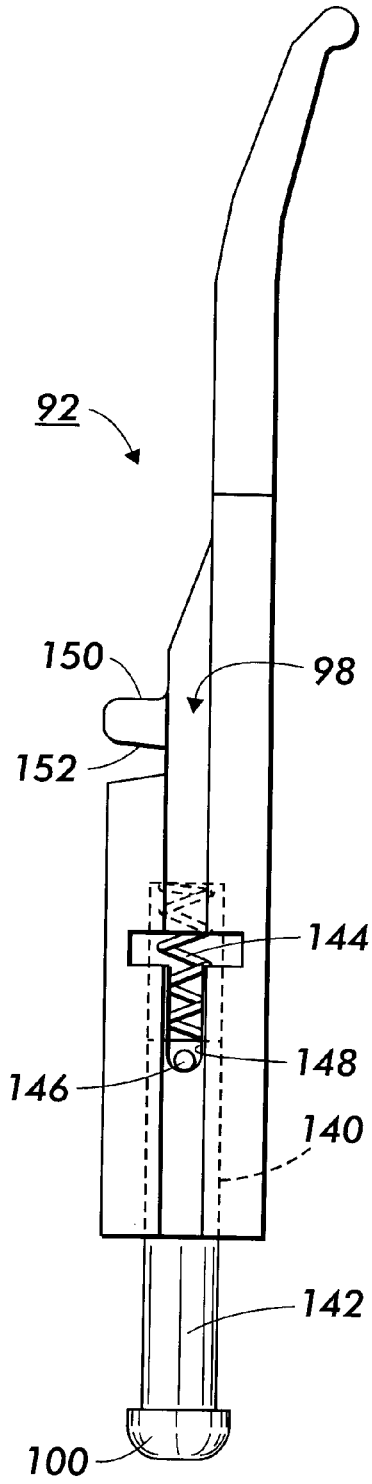
FIGS. 7 and 8 are side plan and perspective views, respectively, of a blade lifter according to one form of the present invention.
Figure 8:
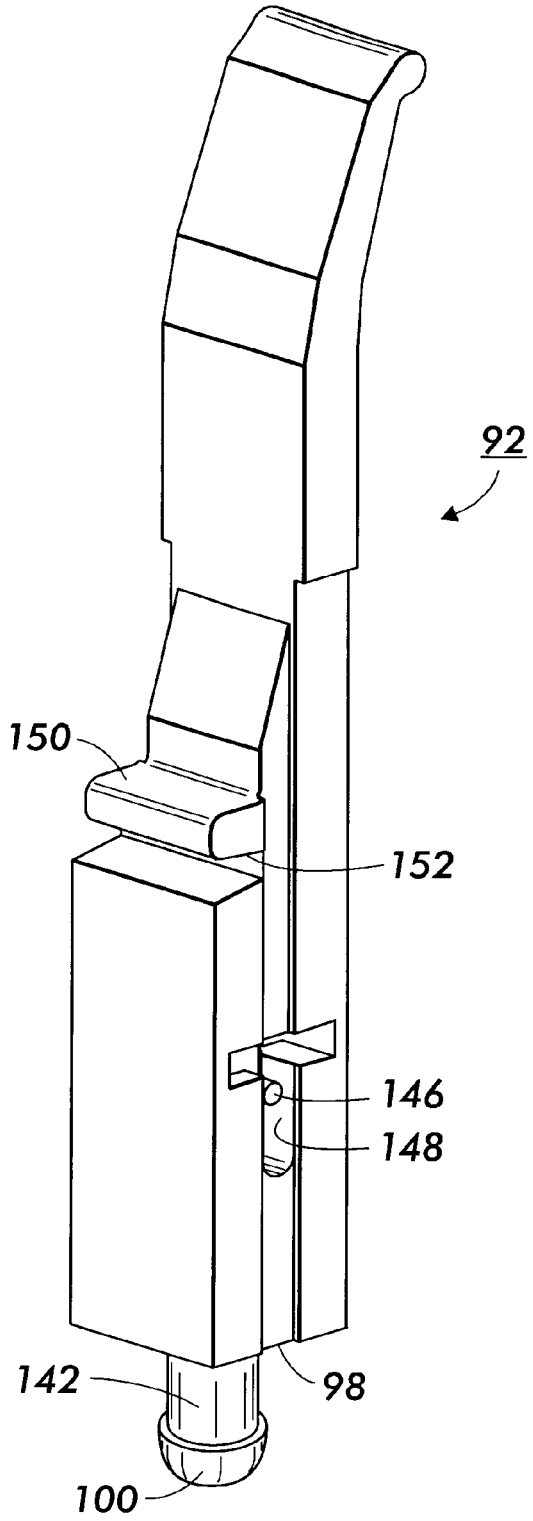

FIGS. 7 and 8 illustrate one possible form of the auxiliary blade lifters 92 for use with the parking brake 130 embodiment of the present invention. According to this optional form, the lower end of each auxiliary blade lifter 92 is provided with a longitudinally extending bore 140. A cam follower 100 is formed on the lower end of a piston or plunger 142. An upper portion of the plunger 142 is sized and shaped to be slidably received in the bore 140 in the auxiliary blade lifter 92. A compression spring 144 is located in the bore 140 in the auxiliary blade lifter, followed by the plunger 142. The plunger 142 is pressed against the compression spring 144 to pre-stress the compression spring 144 and the plunger is then secured in the auxiliary blade lifter 92 by press fitting or otherwise securing a retaining pin 146 in a cross-bore provided in the plunger 142. A longitudinally extending slot 148 is provided in at least one side of the auxiliary blade lifter 92 to provide access to the bore 140 in the plunger 142 for insertion of the retaining pin 146. The retaining pin 146 has a length that is greater than the diameter or cross-section of the top of the plunger 142, such that the retaining pin 146 extends into the slot 148 and thereby retains the plunger 142 in the auxiliary blade lifter 92. The slot 148 has a longitudinal length that is greater than or equal to the length of travel of the auxiliary blade lifter 92 from the inoperative position to the operative position. Thus, the retaining pin 146 may travel up and down in the slot 148, providing the desired range of motion of the plunger 142 within the bore 140.

The side of each auxiliary blade lifter 92 facing the parking brake 130 is provided with a shoulder 150 and a slot that defines a downwardly facing ledge 152. The shoulder 150 and the ledge 152 are spaced by a distance that is somewhat less than the travel distance of the auxiliary blade lifter 92 from the inoperative position to the operative position. The shoulder 150 and the ledge 152 are positioned to engage the parking brake 130 as follows. When a given auxiliary blade lifter 92 is in the lower inoperative position (as shown in ghost in FIG. 3) and the parking brake 130 is in the braking position (as shown in solid lines in FIG. 3), the parking brake 130 is located just above the shoulder 150 (dashed lines in FIG. 3). On the other hand, when a given auxiliary blade lifter 92 is in the upper operative position, then the parking brake 130 is located just below the ledge 152 (solid lines in FIG. 3).

Figure 9:
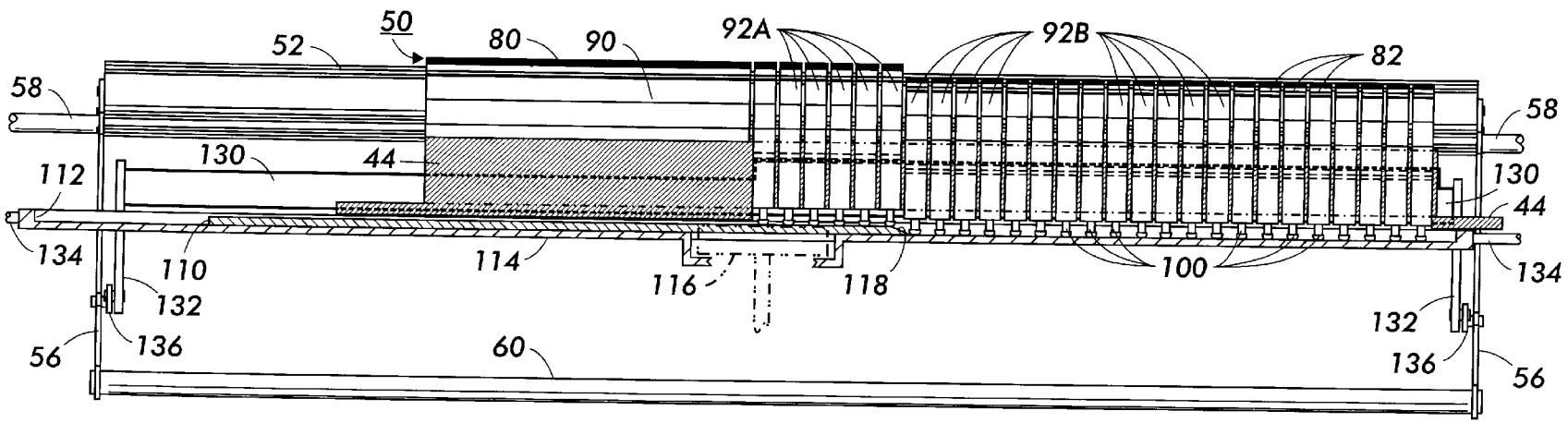
FIGS. 9 through 12 are sequential cross-sectional views illustrating the operation of the transfer assist blade associated actuating mechanism of FIG. 2.
Figure 10:
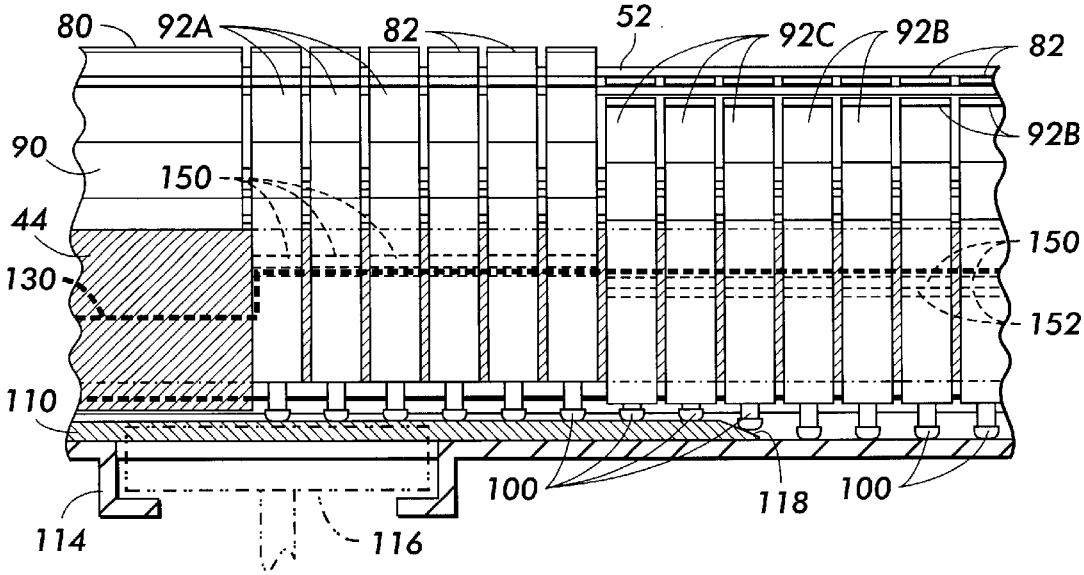

The proposed parking arrangement functions as illustrated in FIGS. 9 through 12, which show the sequence of operation. Before the first print sheet 30 arrives at the transfer station D the transfer assist blade 50 is located in the inoperative position, awaiting the arrival of a print sheet 30. The second stepper motor 114 is activated to move the cam 110 via the pinion gear 116, to the appropriate location that corresponds to the width of the first incoming print sheet 30, as shown in FIG. 9. When in the appropriate location, the cam 110 lifts a number of auxiliary blade lifters 92A, whose cumulative length is equal to or somewhat less than the width of the incoming first print sheet 30 to the upper operative position. The remaining auxiliary blade lifters 92B remain in the lower inoperative position. The cam 110 must be in the desired position shown in FIG. 9 before the leading edge of the print sheet 30 arrives at the transfer station D.

Once the print sheet 30 arrives at the transfer station D, as detected by the optical sheet sensor 72, the first stepper motor 62 is activated to move the transfer assist blade 50 from the inoperative position (FIG. 2) to the operative position (FIG. 3). Since the parking brake 130 is connected to the pivot arms 56 via the links 136, the parking brake 130 moves along with the transfer assist blade 50 into the operative or parked position. In the parked position, the parking brake is located just above the shoulders 150 on the auxiliary blade 130 lifters 92B that are in the inoperative position and just below the ledges 152 on the auxiliary blade lifters 92A that are in the operative position. Thus, the parking brake 130 parks or locks the auxiliary blade lifters 92 in position, such that the cam 110 may be moved without affecting the positions of the auxiliary blade lifters 92 or the auxiliary blade segments 82.

With the transfer assist blade 50 and the parking brake 130 in the operative position, the auxiliary blade lifters 92 are locked in place as described above. As a result, when a next incoming print sheet 30 is of a different width than a print sheet 30 that is currently passing through the transfer station D, the cam 110 may be moved to a new position corresponding to the width of the incoming print sheet 30 without moving the auxiliary blade lifters 92 or altering the effecting transfer assist blade length. When the cam 110 is moved to a new position with the parking brake 130 in the operative locking position, for example, to the right underneath additional auxiliary blade lifters 92C as shown in FIG. 9, the cam followers 100 of the additional auxiliary blade lifters 92C are raised by the cam 110. The additional auxiliary blade lifters 92C themselves, however, are locked in place by the engagement of the parking brake 130 with the shoulders 150 on the additional auxiliary blade lifters 92C. Thus, the plungers 142 move up in the bores 142 in the additional auxiliary blade lifters 92C compressing the springs 144, but the additional auxiliary blade lifters 92C remain in the inoperative position as shown in FIG. 9.

Figure 11:
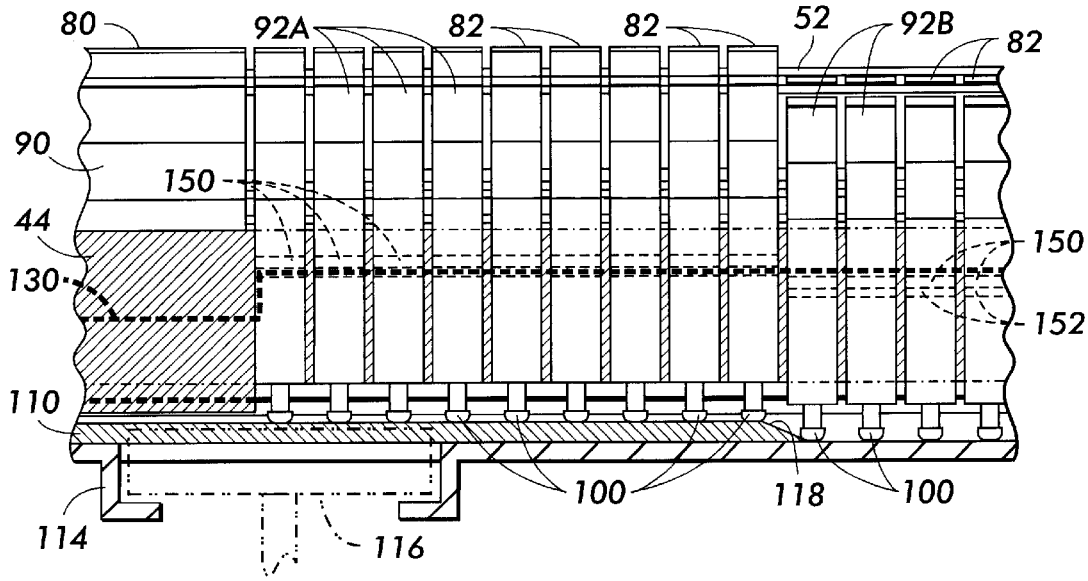

When the current print sheet 30 is about to exit the transfer station D, as detected by the optical sheet sensor 72, the first stepper motor 62 is activated to move the transfer assist blade 50 to the inoperative position. The parking brake 130, which is connected to the pivot arms 56 by the links 136, moves along with the transfer assist blade 50 into the inoperative position clear of the auxiliary blade lifters 92. As a result, the additional auxiliary blade lifters 92C are unlocked or released, and are raised by the compression springs into the upper operative position and become activated raised auxiliary blade lifters 92A as shown in FIG. 11. As the next print sheet 30 moves into the transfer station D, the first stepper motor 62 is activated, thereby moving the transfer assist blade 50 and the parking brake 130 into the operative position. Thus, the appropriate auxiliary blade segments 82 are deflected by the raised auxiliary blade lifters 92A into contact with the next wider print sheet 30.

Figure 12:
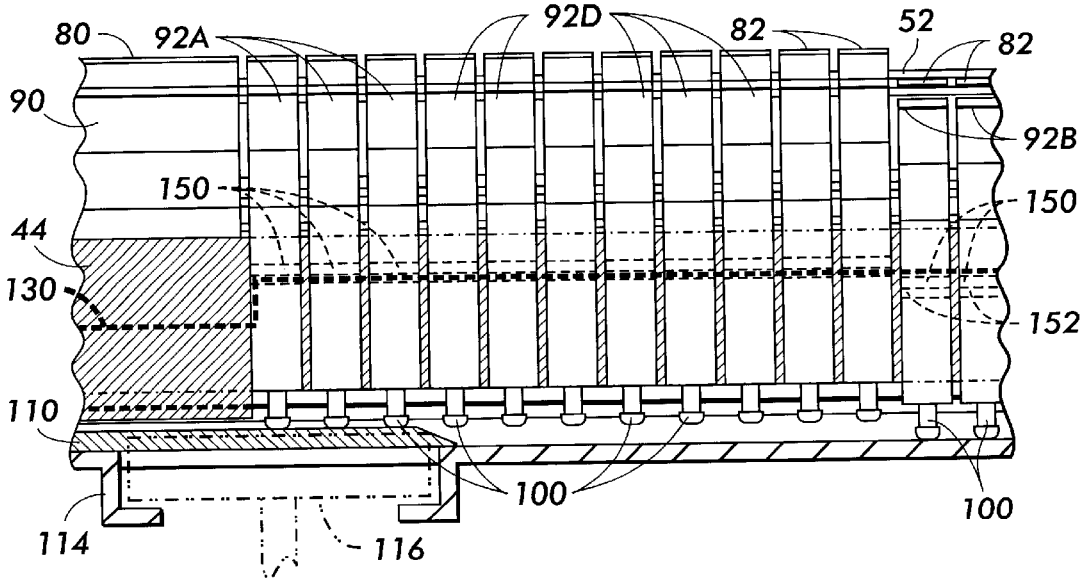

When the next print sheet 30 approaching the transfer station D is narrower than print sheet 30 currently in the transfer station D, the process is reversed. The cam 110 is moved to the left prior to arrival of the next narrower print sheet 30, while the current print sheet 30 is still within the transfer station D and the auxiliary blade lifters 92 are locked in place by the parking brake 130 as shown in FIG. 12. The transfer assist blade 50 and the parking brake 130 are maintained in the operative position until the current print sheet 30 is about to exit the transfer station D. As a result, the cam 110 moves out from below the cam followers 100 of the auxiliary blade lifters 92D that are to be lowered for the next narrower print sheet 30. However, auxiliary blade lifters 92D remain locked in the operative position by engagement of the parking brake 130 with the ledges 152 and remain in the raised operative position (see FIG. 12). When the current print sheet 30 is about to exit the transfer station D, the transfer assist blade 50 and the parking brake 130 are moved into the inoperative position. At which point, the auxiliary blade lifters 92D will drop to the inoperative position (not shown, but similar to FIG. 9).

While the present invention has been described in connection with an illustrative embodiment, it will be understood that the preceding description is not intended to limit the invention to the specifics of the disclosed embodiment. On the contrary, the description is intended to cover all alternatives, modifications, and equivalents that may be included within the spirit and scope of the invention as defined by the appended claims. Other aspects, features and embodiments of the present invention will become apparent to one of skill in the art upon reviewing the preceding description and the accompanying drawings.

For example, it will be understood that the rack and pinion arrangement of the pinion gear 116 and the cam 100 is only one of many systems that may be employed to activate the auxiliary blade lifters 92. For example, a cam shaft, lead screw, cable drive, or other well known mechanisms may be employed to activate the auxiliary blade lifters 92 or an associated cam. The rack and pinion arrangement does have space saving advantages over many of the other options and may be the best choice when a large number of auxiliary blade lifters 92 are desired and free space within the machine is limited. Thus, the disclosed rack and pinion arrangement is just one optional feature of the present invention.

The other features of the present invention, such as the reverse actuation of the transfer assist blade 50 (i.e. actuation by moving the transfer assist blade 50 away from the photoconductive belt 14 and into engagement with a stationary blade lifter) and the parking brake feature, may be employed separately or with alternative mechanisms without departing from the spirit of the present invention. When the parking brake feature is employed separately from the reverse actuation, then the transfer assist or contact blade 50 may be stationarily mounted relative to the imaging surface or member. In this case, the blade lifters or deflectors 70 move into contact with the stationary blade segments and deflect the blade segments into contact with the print sheet 30.

What is claimed is:

1. An apparatus for enhancing contact between print sheets having different widths and a developed image on an imaging surface, comprising:

a contact blade, formed of a plurality of blade segments, mounted parallel to and spaced from said imaging surface;

a plurality of blade lifters, one blade lifter for each of said blade segments, said blade lifters being individually movable from an inoperative position immediately adjacent to said blade segments to an operative position in which said blade lifters engage said blade segments and deflect said blade segments causing tips of said blade segments to contact a print sheet contacting said imaging surface and press said print sheet against said imaging surface;

a lifter activating device for moving a current select number of adjacent said blade lifters into said operative position, said current select number being selected such that a current number of adjacent blade segments having a cumulative length that is equal to a width of a current said print sheet currently contacting said imaging surface are deflected and contact with said current print sheet; and a lifter locking member for engaging said current select blade lifters in said operative position and current non-selected said blade lifters in said inoperative position while said current print sheet is in contact with said imaging surface.

2. An apparatus according to claim 1, wherein said lifter locking member engages said blade lifters until a trailing edge of said current print sheet is about to pass said contact blade, whereby said activating device can be adjusted for lifting a subsequent select number of adjacent blade lifters into said operative position while said current blade segments are contacting said current print sheet without moving any of said blade lifters while said current blade segments are contacting said current print sheet, said subsequent select number being selected such that a subsequent number of adjacent blade segments having a cumulative length that is equal to a width of a subsequent incoming said print sheet;

and said lifter locking member disengages said blade lifters when a trailing edge of said current print sheet is about to pass said contact blade causing said subsequent select blade lifters to deflect said subsequent adjacent blade segments into contact with said subsequent print sheet.

3. An apparatus for enhancing contact between print sheets having different widths and a developed image on an imaging surface, comprising:

a contact blade mounted parallel to and spaced from said imaging surface, said contact blade being formed of a plurality of blade segments;

a plurality of blade lifters, one blade lifter for each of said blade segments, said blade lifters being individually movable from an inoperative position immediately adjacent to said blade segments to an operative position in which said blade lifters engage said blade segments and deflect said blade segments causing tips of said blade segments to contact a print sheet contacting said imaging surface and press said print sheet against said imaging surface;

a guideway extending along ends of said blade lifters remote from said contact blade;

an elongate cam slidably mounted in said guideway, said cam having gear teeth formed along one side thereof;

a pinion gear mounted adjacent to said guideway in engagement with the gear teeth on said cam; and a motor operatively connected to said pinion gear for rotating said pinion gear, moving said cam in said guideway, and thereby moving and engaging a select number of said blade lifters with said cam and moving said select number of blade lifters into said operative position, said select number being selected such that a select number of adjacent blade segments having a cumulative length that is equal to a width of a print sheet contacting said imaging surface are deflected and contact said print sheet.

* * * * *